United States Patent [19]

Stinson

[11] Patent Number: 4,480,610

[45] Date of Patent: Nov. 6, 1984

[54] REMOTE OIL LEVEL INDICATOR

[75] Inventor: Joseph B. Stinson, Fremont, Ohio

[73] Assignee: Joseph B. Stinson Co., Fremont, Ohio

[21] Appl. No.: 576,662

[22] Filed: Feb. 3, 1984

[51] Int. Cl.[3] ..... F01M 1/00

[52] U.S. Cl. ..... 123/196 S; 184/6.4; 73/302

[58] Field of Search ..... 123/196 S; 184/6.4; 73/302

[56] References Cited

U.S. PATENT DOCUMENTS

| | | | |
|---|---|---|---|
| 1,792,754 | 2/1931 | Myers | 73/302 |
| 4,299,307 | 11/1981 | Scott | 184/6.4 |
| 4,338,809 | 7/1982 | Englund | 73/302 |
| 4,407,159 | 10/1983 | Wytaniec | 73/302 |

FOREIGN PATENT DOCUMENTS

| | | | |
|---|---|---|---|
| 1965609 | 9/1971 | Fed. Rep. of Germany | 184/6.4 |

*Primary Examiner*—Ethel R. Cross

*Attorney, Agent, or Firm*—Flynn, Thiel, Boutell & Tanis

[57] ABSTRACT

A system for remotely sensing a low level of a fluid in a tank, such as the low level of oil in an internal combustion engine. A sensing tube projects through a housing defining an oil reservoir therein, which sensing tube is disposed with its open lower end positioned at an elevation which defines the low or add level for the oil. The sensing tube has its upper outer end connected through a suitable conduit to a remotely located actuator. The actuator, preferably manually actuated, transmits a determined mass of air through the conduit means into the sensing tube. A visual indicator senses changes in pressure within the sensing tube. When the lower end of the sensing tube is immersed in oil, the mass of air supplied to the system effects a pressure increase which is recorded on the indicator, thus indicating that the oil level in the reservoir is above the low or add level. However, if the oil level is low so that the lower end of the sensing tube is not immersed in oil, then the mass of air passes into the open upper region of the reservoir without creating any significant pressure pulse.

10 Claims, 2 Drawing Figures

REMOTE OIL LEVEL INDICATOR

FIELD OF THE INVENTION

This invention relates to a device for reading or sensing the level of liquid in a reservoir, specifically the level of oil in a reservoir, such as an engine crankcase, and more particularly to a system which permits a remote determination as to whether the oil level is "low" so as to require addition of oil to the reservoir.

BACKGROUND OF THE INVENTION

The oil level in an engine crankcase or transmission, specifically on vehicles such as automobiles and boats, is traditionally manually checked by means of a dipstick which extends through a tube into the oil reservoir, with the dipstick being manually removed to permit visual inspection of the oil level indicator scale thereon. The manually removable dipstick, while having been extensively utilized for many years, is nevertheless undesirable inasmuch as it requires direct access to the engine, which access is often rather difficult, and hence, there is a tendency to omit periodic checking of the oil level. This in turn can hence result in serious engine damage due to the engine being operated with inadequate quantities of oil for lubricating same. Over the years, there have been proposed various techniques for permitting remote reading or sensing of the oil level, specifically in the crankcase of a vehicle engine. These proposals, however, have generally involved rather complex systems which employ a mechanical linkage extending from the engine crankcase to a remote location, such as a vehicle dashboard, or in the alternative employ some type of pumping mechanism for sensing oil level in the crankcase. These known devices have hence generally required complex linkage or transmission arrangements, or in the alternative have required modification of the engine so as to accommodate the level-sensing system. These systems have hence been less than desirable. Typical systems of this type are illustrated by U.S. Pat. Nos. 1,508,969, 1,521,195, 1,526,377, 1,781,756 and 2,624,790.

There has also been proposed a system for determining the quantity of liquid in a tank by utilizing a manually actuated pressure system for determining the height of the liquid column within the tank. In this system, the upper portion of the tank is drilled to provide an access hole, and an elongated piece of tubing is inserted downwardly through the hole so that the open lower end of the tubing is positioned closely adjacent, such as about one inch from, the bottom of the tank. The other end of the tubing is connected to an instrument panel which has a pressure gauge and a pressure actuator associated therewith. By manually actuating the pressure actuator so as to pressurize the column of air in the tubing, this hence enables a determination as to the height of the liquid in the tank (that is, the height of the liquid above the open lower end of the tubing) since, by gradually pumping the actuator to build up pressure, the gauge will indicate this pressure buildup, which pressure buildup occurs until the air pressure equals the column-height pressure of the liquid in the tank, after which air will bubble or bleed out of the open lower end of the tube and hence stabilize the pressure in the system. This known system is hence designed for determining the height of liquid in the tank, and is not designed for sensing the "low" or "add" level such as in a conventional engine housing. Further, in this known system, the requirement of drilling a hole in the housing and then inserting a tube therethrough makes installation of the system undesirably complex. This known system has, however, been utilized on boats and the like for determining the quantity of liquid in tanks, such as for determining the quantity of fuel in the fuel tank.

Accordingly, the present invention relates to an oil level indicator system and, more particularly, to a system which remotely indicates when oil should be added to the reservoir due to the level in the reservoir being below the lowest acceptable limit. This improved system is highly desirable since it can be readily utilized in conjunction with existing engines or transmissions by utilizing the standard dipstick tube associated therewith, whereby the engine or transmission does not require any rebuilding or modifying, and at the same time the improved system does not require any complex mechanical linkages. This improved system hence effectively overcomes the disadvantages associated with prior remote oil-level indicator systems.

In the improved system of the present invention, a level-sensing tube is fixedly positioned within and inserted through the standard dipstick tube as fixedly associated on most engines and transmissions. This level-sensing tube is inserted through the dipstick tube and positioned such that the lower end of the level-sensing tube is disposed substantially at the "low" or "add" oil level. The level-sensing tube in turn is connected through a main conduit, such as an elongated flexible tube, to a pressure pulse actuator which is remotely located, such as mounted on the dashboard of an automobile or boat. This pressure pulse actuator, which in the preferred embodiment is a manually actuated air cylinder, is capable of transmitting a pressure pulse through the conduit and through the level-sensing tube into the oil reservoir. A secondary conduit is connected between the main conduit and an indicator, such as a pressure gauge, which is also mounted on the vehicle dashboard. If the oil level in the reservoir is above the "low" or "add" level, then the lower end of the level-sensing tube is immersed in the oil so that, when a mass of air is transmitted through the level-sensing tube, the oil which closes off the lower end of the tube causes a pressure buildup which is transmitted through the secondary conduit so as to cause movement of the indicator associated with the pressure gauge into a "safe" range, which indicator remains in this "safe" ' range to indicate that the oil level is satisfactory. On the other hand, if the level of oil in the reservoir is at or below the "add" level, then the lower end of the sensing tube is exposed and hence in communication with the region of the reservoir located above the oil, which region is filled with gas, namely air. Hence, when the pressure pulse actuator is activated, the mass of air flows through the main conduit and the level-sensing tube into the upper region of the reservoir, whereupon there is rapid dissipation of the air mass, and hence no significant buildup of pressure. While the pressure pulse may cause an initial displacement of the pressure gauge indicator due to flow resistance within the conduits, nevertheless this is only a momentary displacement and the indicator rapidly returns to its initial position so as to indicate that the oil level is low, and that further oil should be added.

The improved system of this invention is highly desirable due to its structural simplicity, its ease of use, its long-term dependability in term of reliable and maintenance-free operation, its ease of adaptability on all types of existing engines, specifically all types of vehicle engines, and its simplicity of operation.

Other objects and advantages of the present invention will be apparent after reading the following specification and inspecting the accompanying drawings.

Figure 1:
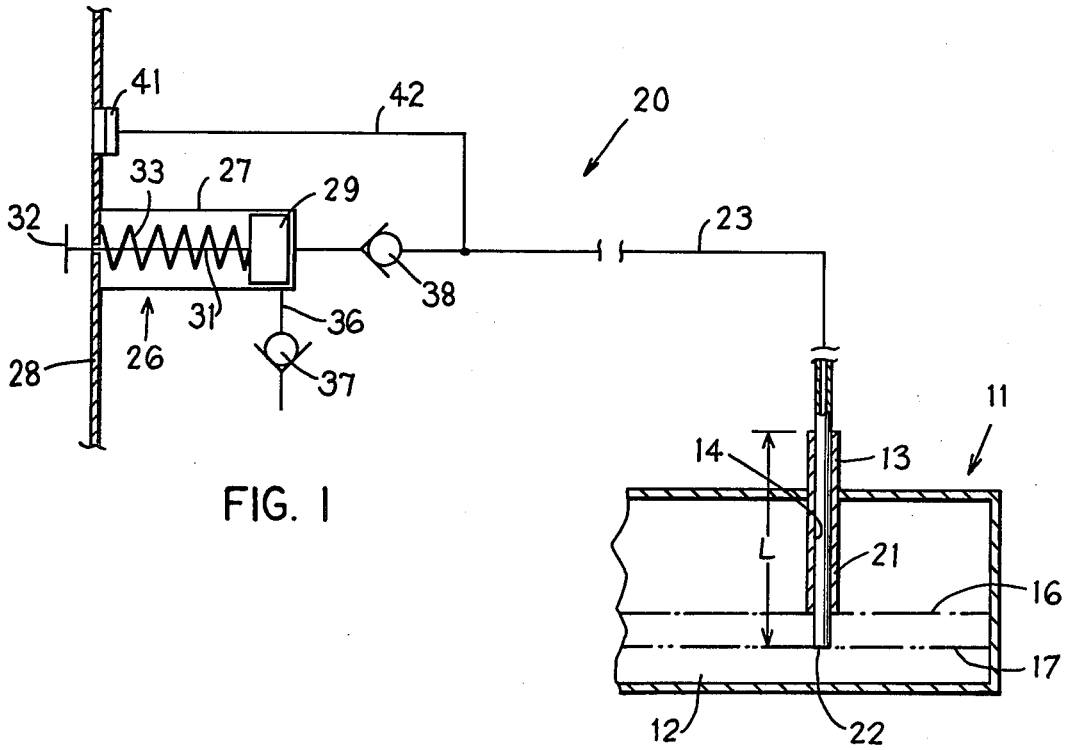
FIG. 1 diagrammatically illustrates a remote oil-level sensing system of this invention, specifically when used in conjunction with the crankcase of a vehicle engine.
Figure 2:
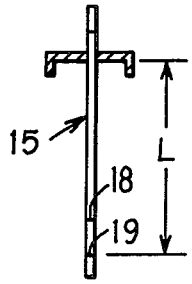
FIG. 2 illustrates a conventional dipstick.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Referring to the drawing, there is diagrammatically illustrated a housing or crankcase 11 as associated with an internal combustion engine of a vehicle. This crankcase 11 defines therein a reservoir 12 for liquid lubricant, specifically oil. A conventional guide tube 13 is fixed to the crankcase 11 and projects into the reservoir 12. This guide tube has an opening 14 therethrough which conventionally accommodates a manually removable dipstick 15 for permitting determination as to the oil level within the reservoir. In this regard, the reservoir normally has an upper oil level, as indicated at 16, to indicate when the reservoir is "full". Similarly, there is also a lower or "add" oil level, as diagrammatically indicated at 17, to indicate when oil should be added to the reservoir. These full and add levels 16 and 17 correspond to "full" and "add" lines 18 and 19, respectively, as conventionally provided on the dipstick.

According to the present invention, there is provided a system 20 for sensing when the oil in the reservoir 12 is at the "low" or "add" level 17, which sensing of this "low" level 17 is remotely controlled so as to not require direct access to the engine.

The system 20 includes a level-sensing tube 21 which basically takes the place of the conventional dipstick 15. This tube 21 is positioned within and extends downwardly through the guide tube 13, with the level-sensing tube 21 being stationarily positioned within the guide tube 13, such as by means of a snug friction fit. The level-sensing tube 21 is disposed so that its open lower end 22 is positioned substantially at, or just slightly above, the "low" level 17. This is accomplished by measuring the length L of the dipstick between its cap and its "add" line 19, whereupon the length L of tube 21 is inserted into the guide tube 13 as measured from the upper end of the latter. The upper end of level-sensing tube 21 is connected to a main elongate conduit 23, such as an elongate flexible tube, which at its other end is connected to the discharge port of a pressure pulse actuator 26. This pressure pulse actuator 26 is remotely located and is preferably designed so as to be manually actuated to permit checking of the oil level in the reservoir at desired selected intervals.

The pressure pulse actuator 26 in the illustrated embodiment comprises a pneumatic cylinder having a cylinder housing 27 which is mounted on a support 28, such as a support associated with the dashboard or control panel of a vehicle. A piston 29 is slidably and sealingly supported within the housing 27 for reciprocal movement, and is provided with a rod 31 projecting outwardly from one end thereof, which rod has a handle 32 positioned adjacent the dashboard 28 so as to be readily accessible. A biasing means, such as a spring 33, normally urges the piston 29 into its forwardmost position as illustrated in the drawing.

An inlet passage 36 connects to an inlet port which provides communication with the interior of the cylinder housing 27 forwardly (rightwardly) of the piston 29 to permit a mass of air to be sucked into the cylinder housing. A conventional one-way check valve 37 is associated with this passage 36 to permit air to flow into, but not out of, the cylinder housing. The forward end of the cylinder housing 27 also has an outlet port which connects to the primary conduit 23, which conduit in the vicinity of the actuator 26 is preferably provided with a conventional one-way check valve 38 so as to permit air to flow therethrough in a direction away (that is, rightwardly) from the cylinder housing, but not in the reverse direction.

An indicator 41 is also preferably mounted on the dashboard 28 in close proximity to the actuator 26. This indicator is responsive to fluid pressure, such as a pressure gauge having a displaceable needle. The indicator is connected to one end of a secondary conduit or passage 42, which conduit in turn at its other end is connected to the primary conduit 23 at a location downstream of the check valve 38.

OPERATION

The system 20 will normally be maintained in the position illustrated in the drawing, in which position the spring 33 maintains the piston 29 at the inner or forward end of its cylinder.

Assuming that the operator wishes to check the level of oil in the reservoir 12, then the operator grasps the handle 32 and retracts the piston 29 leftwardly against the urging of the spring 33. During this retraction or suction stroke, atmospheric air flows inwardly through passage 36 past check valve 37 into the chamber defined at the forward (rightward) end of the cylinder housing. During this suction stroke, the check valve 38 prevents creation of a suction in the primary passage 23 downstream of the check valve 38.

The operator then manually releases the handle 32 so that the spring 33 urges the piston 29 forwardly, which in turn causes the mass of air contained in the cylinder to be discharged into the main passage 23 and past the one-way check valve 38. This mass of air also flows into the secondary passage 42 due to the latter being in open communication with the passage 23 downstream of the check valve 38.

If the oil level in the reservoir tank 12 is at a safe level, that is, above the "add" level 17 so that the lower end 22 of tube 13 is immersed in the oil and hence effectively closed off, then the mass of air which is discharged into the passage 23 is effectively trapped and hence is pressurized so as to create a pressure pulse within the system, which pressure pulse is transmitted through the secondary passage 42 and imposed on the indicator 41. This pressure pulse hence causes the indicator 41, such as the needle thereof, to be displaced from its normal rest position into a "safe" reading band on the indicator. Since the pressurized mass of air is effectively trapped within the system, the indicator 41 will hence remain in this displaced "safe" reading band until the oil in the reservoir is agitated, such as due to starting of the engine, whereupon this permits the trapped air to escape into the open upper region of the reservoir so that the indicator returns to its normal position.

On the other hand, if the oil level is at or below the "add" level 17 such that the lower end 22 of sensor tube 13 is not blocked by oil, then the mass of air which is forced into the passage 23 by the piston 29 will readily flow through the sensing tube 21 into the open upper region of the reservoir. This prevents any significant pressure from being built up and maintained within the system. The indicator 41 does not register the presence of a sustained pressure pulse, and hence indicates to the operator that the oil level in the reservoir is "low", and that oil should be added.

During actuation of the system, when the actuator 26 initially supplies pressurized air into the conduits 23 and 42, the friction within the system may cause an initial pressure buildup which in turn causes an initial displacement of the needle associated with the indicator 41. However, the pressure buildup due to friction is only momentary and, if the lower end 22 of sensor tube 13 is not blocked by oil, then the air mass readily flows through the tube into the open upper region of the reservoir, and hence any pressure buildup within the system is rapidly dissipated and the indicator needle rapidly returns to its original position, and hence will not register the presence of any sustained pressure pulse within the system. The failure to indicate such a sustained pressure pulse will thus indicate to the operator that the oil level in the reservoir is "low".

While the illustrated pressure pulse activator 26 is preferred, it will be appreciated that other devices can be utilized for creating the pressure pulse. For example, the pulse actuator could utilize a squeezeable deformable bulb for manually causing a selected quantity of air to be injected into the passage 23.

The system 20 is particularly desirable for use on vehicles having an internal combustion engine, such as automobiles, trucks, tractors and boats, since it permits a remote determination as to whether or not the oil level is "low", and hence permits this check to be made very easily without requiring direct access to the engine. This system, however, is also highly desirable for use on many stationary engines inasmuch as the location in or access to the engine often makes manual checking of the oil level, as by means of a removable dipstick or the like, extremely difficult. The system of this invention permits remote checking in a very simple manner without requiring access directly to the engine, and hence encourages operators to more frequently check to determine that the engine does have a proper quantity of oil or lubricant therein.

While the system has been disclosed primarily as having application to the oil level in an engine, specifically a vehicle engine, it will be appreciated that the system will also be usable for determining a selected liquid level, and in particular the minimum permissible liquid level, in various tanks and reservoirs having a multiplicity of uses.

Although a particular preferred embodiment of the invention has been disclosed in detail for illustrative purposes, it will be recognized that variations or modifications of the disclosed apparatus, including the rearrangement of parts, lie within the range of the present invention.

The embodiments of the invention in which an exclusive property or privilege is claimed are defined as follows:

1. In a vehicle having an internal combustion engine, and a housing defining a reservoir therein, for a liquid lubricant, the housing having a guide tube fixed thereto and projecting inwardly thereof for communication with said reservoir, said guide tube being adapted to receive a conventional manually removable dipstick for indicating the full and low levels of the lubricant in the reservoir, and a system for remotely determining when the lubricant in the reservoir is at or below said low level, the improvement wherein said system comprises:

a sensing tube stationarily positioned within and extending through said guide tube, said sensing tube defining a passage therethrough which terminates in an opening at the lower end of said sensing tube, said lower end being disposed substantially at said low level so that said opening is closed off by the lubricant in the reservoir when the lubricant level is above said low level;

elongated conduit means having one end at a remote location and the other end connected to the upper end of said sensing tube;

actuator means connected to the one end of said conduit means for rapidly supplying a determined mass of air through said conduit means to said sensing tube; and indicator means for sensing the development of a pressure in said sensing tube due to said opening being closed by said lubricant so as to indicate that the level of lubricant in the reservoir is satisfactory and for sensing lack of said pressure when the lubricant level is low due to said lower end not being closed off by lubricant.

2. The invention according to claim 1, wherein the housing defines the crankcase of the internal combustion engine.

3. The invention according to claim 1 wherein the vehicle has a passenger compartment provided with a control panel, and wherein said actuator means and said indicator means are mounted adjacent said control panel.

4. The invention according to claim 1, wherein the actuator means includes an air cylinder having a manually displaceable piston, the piston having a manual actuator connected thereto for effecting movement of the piston in one direction against the opposition of a resilient biasing means for sucking a determined quantity of air into the cylinder, and said biasing means causing movement of the piston in the opposite direction for causing the air to be discharged from the cylinder into said conduit means.

5. The invention according to claim 4, wherein the air cylinder has an inlet and an outlet which communicate therewith adjacent one side of said piston when the latter is in its normal position, a first one-way check valve associated with said inlet for permitting air to be sucked into said air cylinder when the piston is manually displaced in said one direction, and a second one-way check valve associated with said conduit means for permitting the air to flow solely from said cylinder into said conduit means as the piston moves in said opposite direction.

6. The invention according to claim 5, including a branch conduit connected at one end thereof to said indicator means and at the other end thereof to said conduit means at a location downstream of said second check valve means.

7. The invention according to claim 6, wherein said vehicle has an occupant compartment provided with a control panel, said indicator means being of the visual type and mounted on said control panel so as to be visible from said occupant compartment, and said actuator means being mounted adjacent said control panel and having a manually movable actuating element which is positioned adjacent said control panel and is manually accessible and actuatable from said passenger compartment.

8. The invention according to claim 1, including one-way check valve means associated with said conduit means for permitting flow therethrough solely in a direction from said actuator means toward said sensing tube, and said indicator means being connected in fluid communication with said conduit means at a location downstream of said check valve means.

9. A method of adapting a conventional internal combustion engine for permitting remote sensing of the lubricant level therein, said engine having a conventional housing provided with a dipstick tube fixed thereto and projecting inwardly thereof for communication with the crankcase lubricant reservoir, and a manually removable dipstick mounted on the engine and projecting downwardly through the dipstick tube for contact with the lubricant in the reservoir, the dipstick having an "add" lubricant line thereon, comprising the steps of:

removing the dipstick;

slidably inserting a sensing tube downwardly through the dipstick tube through a predetermined distance so that the open lower end of the sensing tube is positioned at the same elevation as the "add" line on the dipstick when the latter is positioned within the dipstick tube;

attaching the other end of the sensing tube through a one-way check valve to a pressure actuator, with said check valve permitting flow therethrough solely in a direction from said actuator to said engine reservoir;

connecting said sensing tube, downstream of said check valve, to a pressure sensor;

sensing an "add" lubricant situation by actuating said pressure actuator to supply a mass of air into and through said sensing tube, with said air passing through said sensing tube due to the lower end of said tube being uncovered by lubricant so that the air can pass upwardly into the open upper region of the reservoir, and hence not create any sustained pressure within the system so that the pressure sensor does not indicate any sustained pressure buildup; and sensing an adequate lubricant level by actuating the pressure actuator to supply a mass of air into the system so that the air is trapped in the system due to the lower end of the sensing tube being closed by the lubricant so that the air in the system creates a pressure buildup which is sustained and causes a sustained pressure indication on the pressure sensor.

10. A method according to claim 9, wherein the dipstick has a cap thereon which abuts against the upper end of the dipstick tube, and including the steps of measuring the length between the "add" line and the underside of the cap, and then slidably inserting the free end of said sensing tube into said dipstick tube through a distance which equals said length as measured from the upper end of said dipstick tube.

* * * * *